United States Patent [19]

Russell

[11] Patent Number: 4,949,857

[45] Date of Patent: Aug. 21, 1990

[54] MANUAL PRESSURE BREAKING SEAL AND BREAKING PATTERN

[76] Inventor: Carl D. Russell, Box 334, Sailisaw, Okla. 74955

[21] Appl. No.: 279,843

[22] Filed: Dec. 5, 1988

[51] Int. Cl.[5] ..... B65D 47/10; B65D 47/36

[52] U.S. Cl. ..... 215/253; 215/32; 215/1 C; 141/114; 222/213; 222/541

[58] Field of Search ..... 215/32, 253, 232; 222/213, 541, 491; 141/114

[56] References Cited

U.S. PATENT DOCUMENTS

| | | | |
|---|---|---|---|
| 3,186,606 | 6/1965 | Williams | 215/253 X |
| 3,601,253 | 8/1971 | Sager | 222/213 X |
| 4,378,069 | 3/1983 | Franco | 222/541 X |
| 4,789,082 | 12/1988 | Sampson | 222/213 X |

*Primary Examiner*—George E. Lowrance

[57] ABSTRACT

A bottle seal that can be manual pressure broken after bottle cap is removed and the spigot end of the oil bottle is entered into the engine oil filler opening in a breakable pattern that retains the seal affixed to the empty oil bottle.

2 Claims, 1 Drawing Sheet

OIL
1
2
3

4
5
6
7
ENGINE OIL FILLER

MANUAL PRESSURE BREAKING SEAL AND BREAKING PATTERN

THE TECHNICAL FIELD OF THE INVENTION

Relates to the pouring of oil from a bottle into an engine.

THE BACKGROUND OF THE INVENTION

Oil bottle caps and seals are removed before starting to pour oil into an engine, which allows the oil to be spilled on the engine and run down the bottle soiling the hands as bottle is tipped to pouring position.

A BRIEF SUMMARY OF THE INVENTION

After the protective screw top cap is removed from the spigot end of the bottle, the bottle remains sealed and the spigot end of the bottle can be entered down into the oil filler passage of the engine before manually effecting the breaking of the seal by tapping the bottom of the oil bottle or squeezing the bottle increasing pressure breaking the seal which is provided with a breaking pattern which allows the bottle to retain the broken seal.

A BRIEF DESCRIPTION OF THE DRAWINGS

Figures 1, 2A, 2B, 2C, 3:
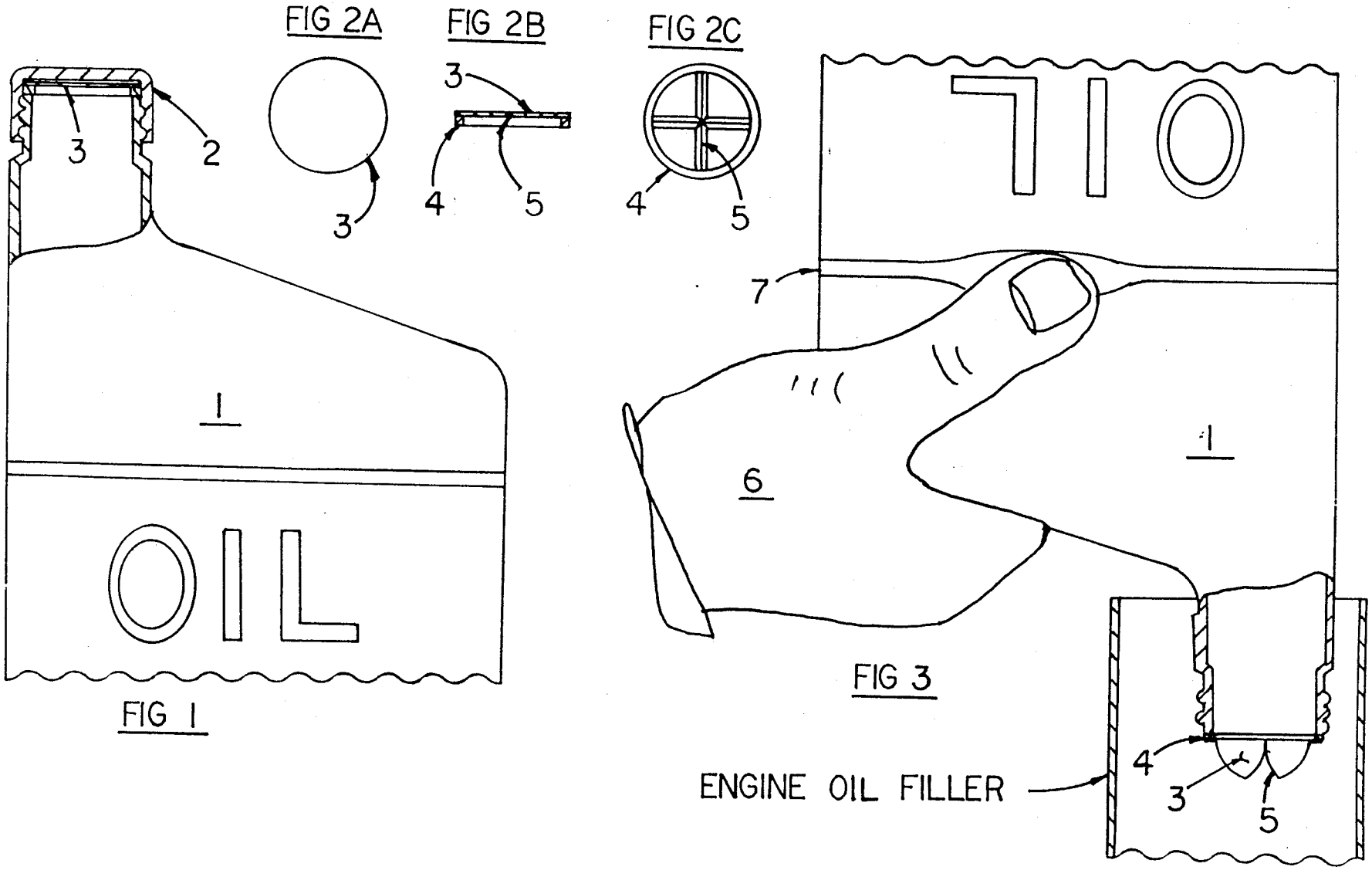
FIG. 1 shows an oil bottle with a cutaway of the bottle neck and a screw cap showing the seal installed on the bottle.
FIG. 2A shows the unbroken surface of the seal material cut to fit the bottle.
FIG. 2B shows the finished seal in cross section.
FIG. 2C shows the scored surface of the seal.
FIG. 3 shows the oil bottle upside down and the seal broken in a pattern to release the oil and retain the borken seal to the empty bottle.

A conventional filled oil bottle, 1 FIG. 1, is provided with a bottle neck and a cap 2 and shows the oil bottle neck sealed by disk 3 via an adhesive 4 affixed to disk 3, (FIG. 1) with the disc being of non absorbent material, protected by a screw top cap 2 (FIG. 1) with the disc being for transporting or storing.

The disk 3, FIG. 2 is of non absorbent material cut to cover the top of the oil bottle 1 (FIGS. 1–3). Disk 3 (FIGS. 1, 2 and 3) is provided with an adhesive 4 (FIGS. 1, 2 and 3), to affix the disk 3 to the bottle 1 (FIGS. 1 and 3) to seal the oil neck passage of bottle 1 (FIGS. 1 and 3). The seal, which can be broken by manual tapping or squeezing, as shown by hand 6, along line 7 or the flexible portion of the bottle 1 (FIG. 3) bursting the seal 3 along the line cross pattern 5 (FIG. 2) leaving the broken seal 3 and adhesive 4 secured to the bottle 1 (FIG. 3).

What is claimed:

1. A viscous motor oil bottle of flexible structure and breakable seal combination for use with the engine oil filler of a vehicle, comprising in combination:

said oil bottle having a hollow spigot with a mouth with a rim of a size to fit within said filler to avoid oil spillage when transferring oil from the bottle to the engine;

a disk closure member seal of non-absorbent material, relative to oil, fitting over the mouth of the oil bottle;

a peripheral coating of adhesive on the closure member for contacting the rim of the bottle causing the member to seal the bottle;

a predetermined breaking pattern in the closure member to permit rupturing of the member when manual pressure is applied to the bottle while having its spigot in said filler; and said pattern being deployed across the closure member in at least two directions to insure that the closure member when fractured will act as a two-way valve by admitting air to the bottle while allowing oil to exit the bottle.

2. A seal for attachment to the rim of the mouth of a non-rigid oil bottle having a hollow spigot of a size to protrude into the engine oil filler of a vehicle, comprising in combination:

said seal comprising a disk closure member of non-absorbent material, relative to oil, fitting over the mouth of the oil bottle;

a peripheral coating of adhesive on the closure member for contacting the rim of the bottle causing the member to seal the bottle;

a predetermined breaking pattern in the closure member to permit rupturing of the member when manual pressure is applied to squeeze the bottle while having its spigot in said filler; and said pattern being a line cross pattern where weakened lines are deployed across the closure member in orthogonal directions to insure that the closure member when fractured along said lines will open sufficiently to act as a two-way valve by admitting air into the bottle while allowing oil to exit the bottle rapidly.

* * * * *